United States Patent [19]

Hemmings

[11] Patent Number: 5,056,608

[45] Date of Patent: Oct. 15, 1991

[54] BORING RAM

[75] Inventor: Kenneth L. Hemmings, Colchester, England

[73] Assignee: British Telecommunications public limited company, United Kingdom

[21] Appl. No.: 543,728

[22] PCT Filed: Jan. 16, 1989

[86] PCT No.: PCT/GB89/00037

§ 371 Date: Aug. 7, 1990

§ 102(e) Date: Aug. 7, 1990

[87] PCT Pub. No.: WO89/07406

PCT Pub. Date: Aug. 24, 1989

[30] Foreign Application Priority Data

Jan. 18, 1988 [GB] United Kingdom ..... 8801042

[51] Int. Cl.[5] ..... E21B 4/14

[52] U.S. Cl. ..... 175/19; 175/297; 173/91

[58] Field of Search ..... 175/19, 26, 61, 62, 175/293, 296, 297, 424; 173/90, 91, 116, 134

[56] References Cited

U.S. PATENT DOCUMENTS

| | | | |
|---|---|---|---|
| 3,137,483 | 6/1964 | Zinkiewicz | 262/1 |
| 3,642,076 | 2/1972 | Coyne et al. | 173/91 |
| 3,759,335 | 9/1973 | Coyne | 173/91 |
| 4,221,157 | 9/1980 | Schmidt | 173/91 |
| 4,250,972 | 2/1981 | Schmidt | 175/19 |
| 4,537,265 | 8/1985 | Cox et al. | 173/91 |
| 4,596,292 | 6/1986 | Crover | 175/19 |

FOREIGN PATENT DOCUMENTS

| | | |
|---|---|---|
| 2134859 | 11/1972 | France . |
| 1026788 | 11/1963 | United Kingdom . |
| 2022169 | 12/1979 | United Kingdom . |
| 2111565 | 7/1983 | United Kingdom . |
| 2187224 | 9/1987 | United Kingdom . |

*Primary Examiner*—Terry L. Melius

*Attorney, Agent, or Firm*—Nixon & Vanderhye

[57] ABSTRACT

In a self-propelled reversible boring ram, selection of forward/reverse boring modes is determined by the position of a control piston. A concentric supply pipe to a source of working fluid pressure connected to coaxial fluid inputs on the ram. Working fluid pressure for an impacting piston (hammer) is supplied through the input. For forward mode operation, pressure from a coil spring and reactive force on the piston is overcome by working fluid pressure on servo pistons. Restricting fluid pressure on the pistons allows the piston to move to reverse mode operating position.

7 Claims, 1 Drawing Sheet

BORING RAM

The present invention relates to a boring ram and in particular to a control mechanism for such a ram.

In United Kingdom Patent No 2111565 (assigned to British Telecommunications public limited company) a self propelled reversible boring ram is disclosed. Boring rams of this kind are now widely used for boring holes under footways and roadways to facilitate the provision of service ducts to carry telecommunication and power cables for example.

One problem associated with boring rams is that of providing a simple control mechanism to the device to effect reversing for example. Another problem is that of a piston in the ram reaching equilibrium.

It is one object of the present invention to provide a simple control mechanism for effecting switching of the direction of travel of a boring ram.

According to the present invention there is provided a boring ram of the kind comprising a tubular body which contains a reciprocal hammer and a pneumatically balanced control member for supplying working fluid to the hammer characterized in that the ram includes first and second working fluid inputs, the first working fluid input supplying working fluid to the hammer and the second working fluid input supplying working fluid to control means responsive to changes in fluid pressure to effect changes in the direction of travel of the ram, the control means having spring means which brings the control main to a first operating direction, working fluid pressure from the second fluid input acting a piston means of the control means to select operation in an opposed direction. Preferably the working fluid inputs are concentric and the two inputs may be connectable by way of a control valve to a common fluid pressure source. For the avoidance of doubt the term working fluid includes, but is not limited to compressed air.

A boring ram in accordance with the invention will not be described by way of example only with reference to the accompanying drawings of which:

Figure 1:
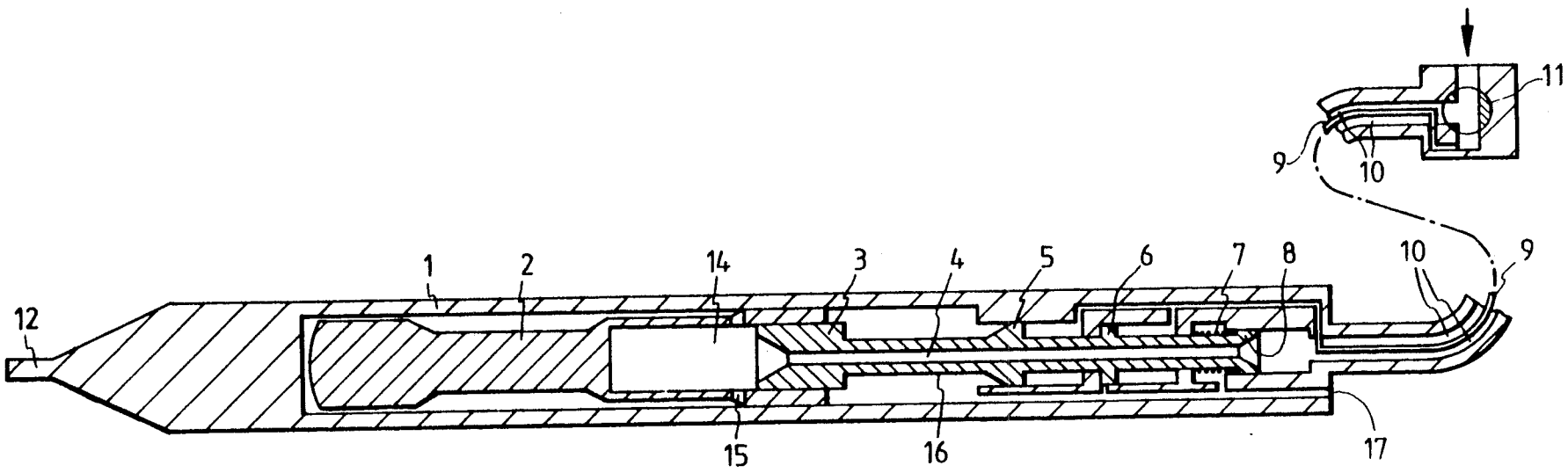
FIG. 1 is a cross sectional view of the ram in forward working mode.

Referring to the drawing, the boring ram which is of the kind sometimes called a self propelled percussion boring ram comprises a tubular body 1 which has a boring head 12 attached at one end, the boring head shown comprising a chisel point.

The tubular body 1 has an internal cavity containing a hammer 2 which has a main cylinder 14 connected by way of control ports 15 to the internal cavity. The cylinder 14 contains a control piston 3, the position of which determines whether the hammer 2 strikes at the forward end (FIG. 1) or at the rearward end (FIG. 2) of its reciprocations.

A shaft 16 extends from the rear of the control piston 3 and is slideably mounted between the walls of the internal cavity. The shaft 16 carries three servo pistons 5, 6 and 8, the purpose of which is hereinafter described and is biased by a coil spring 7 towards the reverse operating position. A full explanation of the working of the reciprocating hammer is given in UK Patent No 2111565 accordingly only abbreviated description is given herein.

In use in the forward mode referring specifically to FIG. 1, working fluid (e.g. compressed air) is supplied at equal pressure to coaxial inputs 9 and 10. A control valve 11, as shown may be used to commence the operation. Working fluid from the inlet 10 enters a tube 4 in the control piston shaft 16 causing the impacting piston 2 to oscillate, the piston 2 moving forward due to the air pressure until ports 15 are open at which point the pressure in the forward chamber rises. This pressure rise causes the piston to move towards the rear (after impaction) which once ports 15 clear the piston 3 allow the pressure to be released through the internal cavity to an exit port 17.

The air pressure also creates a rearward force on the control piston 3 which combines with the coil spring 7 to tend to switch the ram to the reverse operating mode. This force is counteracted by pressure from the fluid input 10 acting on the servo piston 8 and by pressure from the fluid input 9 acting on the servo pistons 5 and 6 thereby firmly holding the control piston in the forward operating position.

Figure 2:
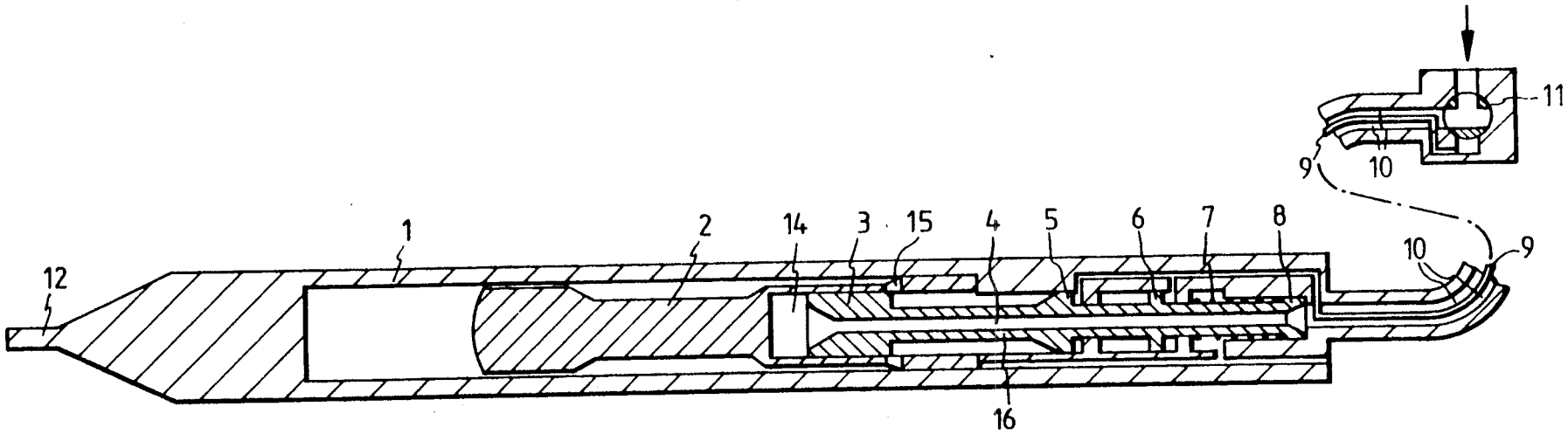
FIG. 2 is a cross sectional view of the ram in reverse working mode.

Referring now to FIG. 2, reverse operation is achieved by turning the valve 11 to cut off the fluid pressure to the input 9. Since no forward pressure now acts on the pistons 5 and 6, the coil spring 7 and reaction forces on the piston 3 will cause the control piston to move to the rearward operating position whereby the impacting piston (reciprocating hammer) 2 drives the ram backwards towards the exit of the channel it has formed.

It will be noted that switching the operative mode does not require the main working fluid supply pressure to be turned off there is therefore less chance of the piston 2 reaching equilibrium and failing to restart when the supply is returned, one of the problems which could occur in prior art devices which required the working fluid supply to be switched off during the changeover.

However, if the impacting piston 2 for any reason reaches a state of equilibrium then by switching the control valve 11 between forward and reverse operation jitter of the control piston 3 may be used to disturb the equilibrium causing the piston 2 to restart.

I claim:

1. A boring ram comprising a tubular body which contains a reciprocal hammer and a pneumatically balanced control member for supplying working fluid to the hammer, the ram including first and second working fluid inputs, the first working fluid input supplying working fluid to the hammer and the second working fluid input supplying working fluid to control means responsive to changes in fluid pressure to effect changes in the direction of the ram, wherein the control means is biased to a first operating direction by a spring and by working fluid pressure acting on at least one piston of the control means to select an opposed working direction and wherein said control means is biased towards a reverse operating direction by a piston acted on by fluid pressure from the first working fluid input to assist selection of a forward operating direction.

2. A boring ram as in claim 1 wherein the first and second working fluid inputs are concentric.

3. A boring ram as in claim 1 further comprising a concentric fluid supply line connected at one end to the first and second working fluid inputs and at the opposed end by way of a control valve to a common source of working fluid pressure.

4. A boring ram as in claim 3 wherein said control valve is movable between a first position at which fluid pressure is supplied to the first and second working fluid inputs, and a second position at which fluid pressure is supplied to the first working fluid input only.

5. A boring ram according to claim 1 wherein cyclic application of fluid pressure and reduced fluid pressure to the control piston is arranged to effect disturbance of equilibrium of the reciprocal hammer.

6. A reversible boring ram comprising:

a body;

a hammer reciprocating within a cavity of said body, fluid pressure is exerted on said hammer by a working fluid supplied to the ram from a first fluid input; and a pneumatically balanced control member reciprocating within said cavity to change the direction of said ram, said control means biased in a first direction by a spring and by the pressure of the fluid supplied through said first fluid input, said control means biased in a second direction, opposite the first direction, by the pressure of working fluid supplied to the ram through a second fluid input;

wherein the pressure of the fluid from said second fluid input is substantially reduced to reverse the direction of said ram.

7. A boring ram as in claim 6 wherein the first and second fluid inputs are concentric and a valve operatively coupled to said second fluid input reduces the fluid pressure through the second input.

* * * * *